US006279526B1

(12) United States Patent
Strzoda et al.

(10) Patent No.: US 6,279,526 B1
(45) Date of Patent: Aug. 28, 2001

(54) VALVE GEAR FOR AN INTERNAL-COMBUSTION ENGINE

(75) Inventors: Walter Strzoda, Barsinghausen; Klaus Gebauer, Seelze, both of (DE)

(73) Assignee: TRW Deutchland GmbH, Barsinghausen (DE)

( * ) Notice: Subject to any disclaimer, the term of this patent is extended or adjusted under 35 U.S.C. 154(b) by 0 days.

(21) Appl. No.: 09/506,769

(22) Filed: Feb. 18, 2000

(30) Foreign Application Priority Data

Jun. 21, 1999 (DE) ..... 199 28 284

(51) Int. Cl.[7] ..... F01L 3/10

(52) U.S. Cl. ..... 123/90.67; 123/188.13; 251/321; 251/337

(58) Field of Search ..... 123/90.65, 90.66, 123/90.67, 188.12, 188.13; 251/321, 337

(56) References Cited

U.S. PATENT DOCUMENTS 4,469,057 * 9/1984 Black ..... 123/90.54
5,044,330 * 9/1991 Havens et al. ..... 123/90.67
5,558,054 * 9/1996 Ariga et al. ..... 123/90.65
5,664,531 * 9/1997 Kim ..... 123/90.65

FOREIGN PATENT DOCUMENTS 2439674 3/1975 (DE) .
19641568 3/1999 (DE) .

* cited by examiner

*Primary Examiner*—Weilun Lo
(74) *Attorney, Agent, or Firm*—Tarolli, Sundheim, Covell, Tummino & Szabo L.L.P.

(57) ABSTRACT

A valve gear controls a gas exchange in an internal-combustion engine with a valve spring which holds a valve in its required position at all times and is clamped between a valve head and a valve-spring support. The valve spring support is adjustable in the direction of the valve axis. The adjustable valve-spring support includes two nested setting rings (2, 3) which are rotatable in opposite directions.

11 Claims, 4 Drawing Sheets

Figure 1:
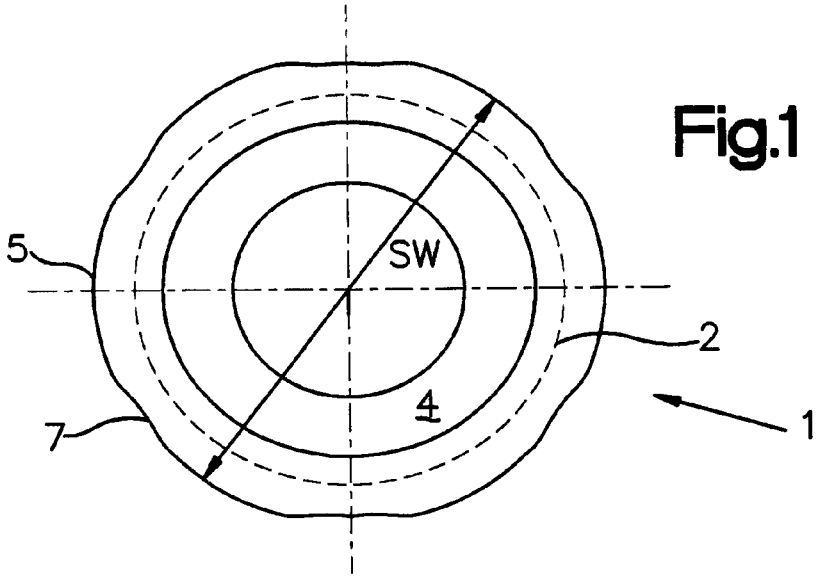

FIG. 11
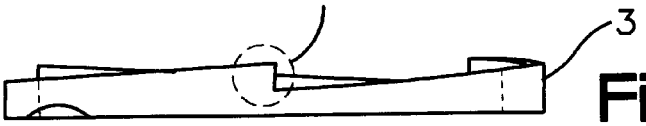
Fig.9
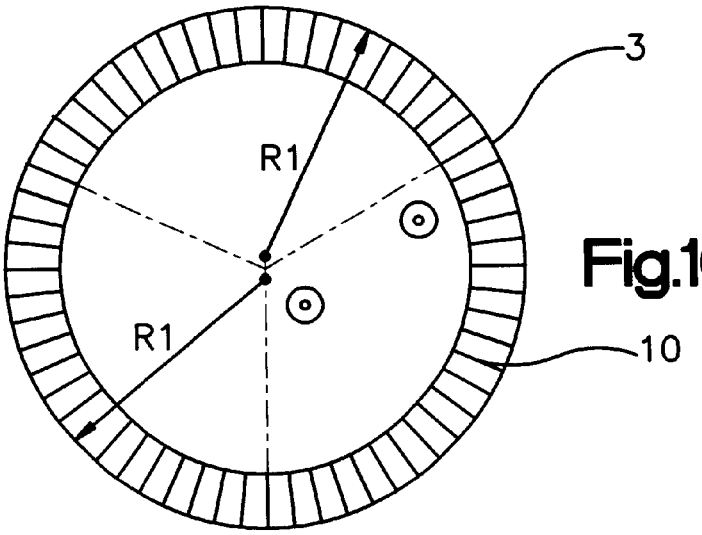
Fig.10
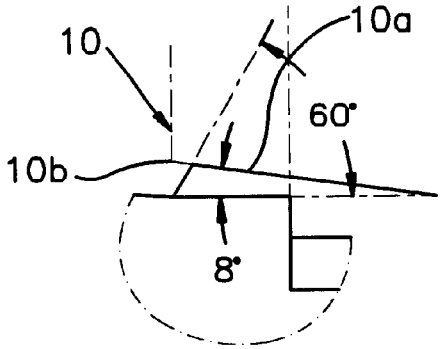
Fig.11

VALVE GEAR FOR AN INTERNAL-COMBUSTION ENGINE

The invention relates to a valve gear for controlling the gas exchange in internal-combustion engines with a valve spring which holds the valve in its required position at all times and is clamped between the valve head and a valve-spring support which can be adjusted in the direction of the valve axis.

DE-A 24 39 674 discloses providing the end of a valve stem with a screw-on tappet foot to allow rapid setting of the valve operating clearance. The valve clearance between the tappet foot and the camshaft can be varied and hence set by screwing motions. A ring-gear-like ratchet device, in which the tappet foot engages by means of external toothing, is provided to enable a setting, once performed, to be fixed over a long period of operation.

In a valve gear without a camshaft disclosed in DE-A 197 41 568, the valve clearance can likewise be set by means of the armature of an electromagnetic drive. In this valve-clearance setting device too, the spacing between the actuating element and the valve stem can be varied by means of a locking screw which oscillates with the armature. Unwanted adjustment due to engine vibration is prevented by a spring-loaded detent element which acts on a toothed adjusting segment.

The two known embodiments do not allow the magnitude of the valve force to be influenced. However, manufacturing tolerances in the valve-gear elements involved, which may be cumulative, often result in different spring preloads. There is a requirement for the same spring preload for all valves particularly in the case of valve gear without a camshaft. The spring preload must therefore be set individually for each valve because of the different tolerances. This applies particularly to the electromechanical valve gear. If it is not possible to set the spring preload, the energy expended to drive the valves must be set higher to enable high forces of strong springs to be overcome as well.

The object on which the invention is based is to provide a valve gear of the generic type stated at the outset by means of which a defined spring preload can be set for each individual valve.

The solution according to the invention allows the valve-spring preload to be set to a defined value, even in the case of a valve gear without a camshaft for example. By virtue of the possibility of finely graduated, self-locking, manual adjustment, irrespective, for example, of spring forces, tolerance accumulation and mechanical influences, the defined spring preload of each valve can be set separately. As a result, energy consumption can be reduced to a minimum, particularly in the case of a valve gear without a camshaft. In a valve gear without a camshaft, e.g. an electromechanical valve gear, the spring preloads of all valves can be set to the same level. Different tolerances can be eliminated. The energy requirement for all the valves is therefore the same and, in accordance with the theoretically required force, is low. If such a setting means were not used, the energy expenditure would have to be set higher to enable high forces of strong springs to be overcome as well.

Figure 2:
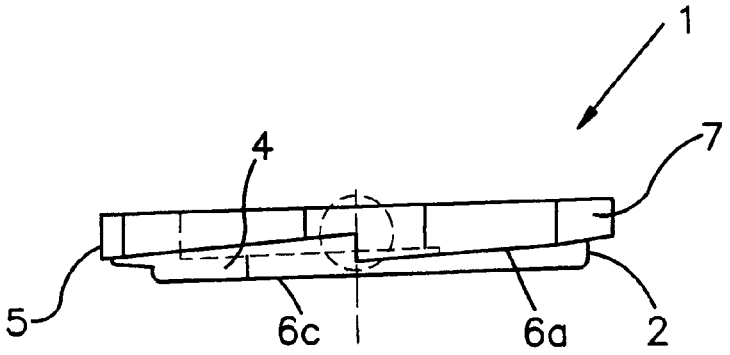
Figure 3:
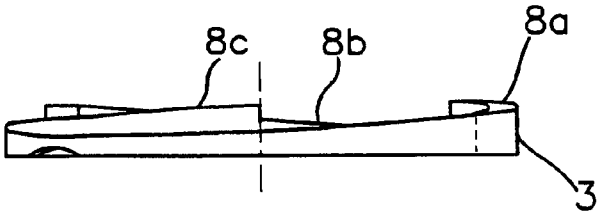
Figure 5:
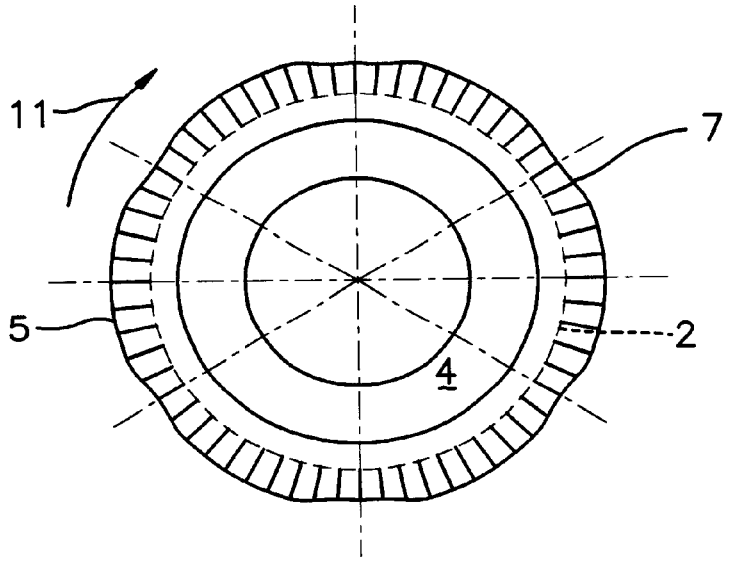
Figure 4:
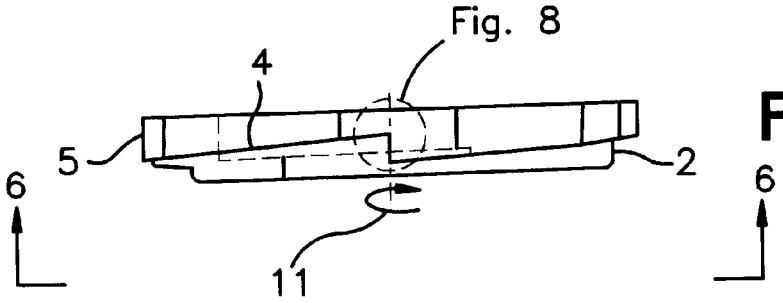
Figure 6:
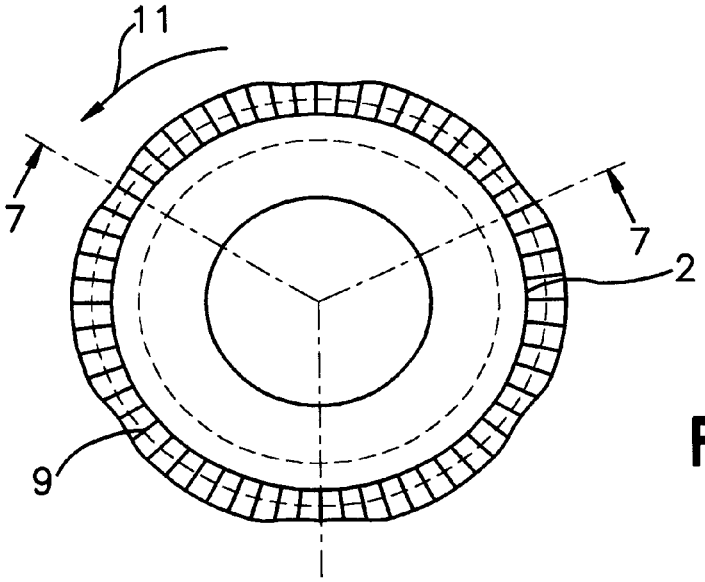
Figure 7:
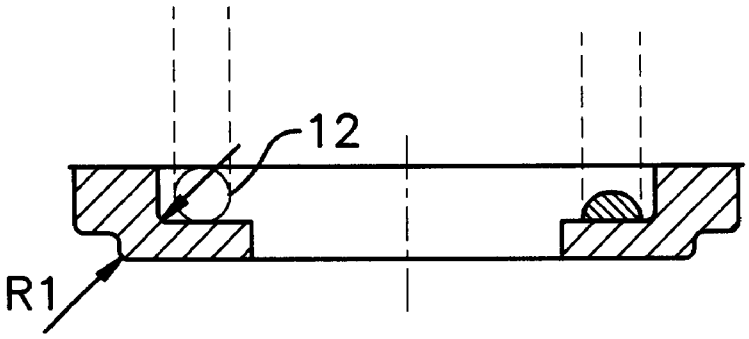
Figure 8:
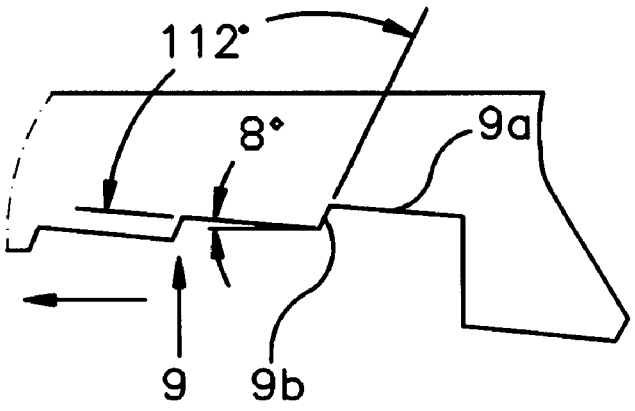

An illustrative embodiment of the invention is shown schematically in the drawing and explained below. In the drawing:

FIG. 1 shows a plan view of the valve-spring support,

FIG. 2 shows a side view of the inner setting ring of the valve-spring support, partially in section, FIG. 3 shows a side view of the outer setting ring of the valve-spring support, partially in section, FIG. 4 shows another side view of the inner setting ring, FIG. 5 shows a view of the inner setting ring from below, FIG. 6 shows a plan view of the inner setting ring, FIG. 7 shows the section B—B (in FIG. 6) through the inner setting ring, FIG. 8 shows a detail in the region of the setting pressure faces of the inner setting ring, FIG. 9 shows another side view of the outer setting ring, FIG. 10 shows a plan view of the outer setting ring and FIG. 11 shows a detail of the outer setting ring in the region of the toothed setting pressure faces.

The adjustable valve-spring support 1 comprises two nested setting rings 2 and 3. The inner setting ring 2 has a supporting surface 4 which extends radially inward and upon which the valve spring 12 is intended to rest. The inner setting ring is provided in its upper region with an outer collar 5. This has setting pressure faces 6*a* to 6*c* distributed around its circumference. More than three setting pressure faces distributed around the circumference can also be used, however. The outer circumference of the collar 5 has a plurality of flats 7 which are distributed around its circumference and are intended for the application of a setting tool to twist the inner setting ring 2 relative to the outer setting ring for the purpose of setting the spring.

On its side facing the setting pressure faces 6*a* to 6*c* of the inner setting ring 2, the outer ring 3 is provided with congruent setting pressure faces 8*a* to 8*c*, which are in operative connection with the setting pressure faces 6*a* to 6*c*.

All the setting pressure faces are provided with profiling to establish form-fitting engagement between the faces involved. The example shows directional toothing with flat tooth links of different lengths and enclosed flank or wedge angles of 112°, as shown by the details in FIGS. 8 and 11.

To set a predetermined spring strength, the inner setting ring 2 is rotated in the direction of the curved arrow 11, allowing the ratchet teeth 9 to slide by their long flanks 9*a* on the long flanks 10*a* of the ratchet teeth 10 until their steeper, short flanks 9*b* engage behind the corresponding short flanks 10*b* of the ratchet teeth 10 of the outer setting ring. Since the teeth are arranged on setting pressure faces which rise in the manner of a thread, the supporting surface 4 is raised in the process and the valve spring is increasingly compressed, until the spring force has reached a predetermined value. In this way, it is possible to set each individual valve spring of an engine to the same value.

What is claimed is:

1. A valve gear for controlling the gas exchange in internal-combustion engines with a valve spring which holds a valve in its required position at all times and is clamped between a valve head and a valve-spring support which is adjustable in the direction of the valve axis, wherein the adjustable valve-spring support comprises two nested setting rings (2, 3) which are rotated in opposite directions and at which the inner setting ring (2) has a collar (5) for supporting the valve spring (12) and is movable in the direction of the valve axis by means of the rotation relative to the outer setting ring (3), the setting rings having elements (9, 10) to prevent return rotation.

2. The valve gear as claimed in claim 1, wherein the setting rings are embodied with setting pressure faces (6*a*, 6*b*, 6*c*; 8*a*, 8*b*, 8*c*) which slide upon one another and rise in the form of a thread.

3. The valve gear as claimed in claim 2, wherein the setting pressure faces are provided with self-locking profiling (9, 10), which interengages in a form-fitting manner, to prevent return movement.

4. The valve gear as claimed in claim 3, wherein the setting pressure faces are provided with detent notches.

5. The valve gear as claimed in claim 4, wherein the setting pressure faces are provided with ratchet toothing (9, 10) which has a direction-dependent action.

6. The valve gear as claimed in claim 2, wherein the inner setting ring (2) has a supporting surface (4) for the valve spring (12) and is supported by means of its setting pressure faces **(6*a*–6*c*) by the outer ring (3)**, the out ring resting on a cylinder head.

7. The valve gear as claimed in claim 6, wherein the outer setting ring (3) is secured against rotation by form-fitting engagement with the cylinder head.

8. The valve gear as claimed in claim 7, wherein the outer ring rests by an outer contour of non-circular configuration in a correspondingly configured depression in the cylinder head.

9. The valve gear as claimed in claim 1, wherein the outer contour of the outer ring comprises two identical part-circles, the centers of construction of which are spaced apart and the ends of which are connected to one another by straight lines.

10. The valve gear as claimed in claim 1, wherein the setting rings are each provided with at least three setting pressure faces **(6*a*–6*c*; 8*a*–8*c*)**, which rest upon one another in pairs.

11. The valve gear as claimed in one of claim 1 wherein the outer contour of the inner ring is provided with faces (7) for a setting tool.

* * * * *

UNITED STATES PATENT AND TRADEMARK OFFICE

CERTIFICATE OF CORRECTION

PATENT NO. : 6,279,526 B1
DATED : August 28, 2001
INVENTOR(S) : Walter Strzoda et al.

It is certified that error appears in the above-identified patent and that said Letters Patent is hereby corrected as shown below:

Column 3,
Line 6, change "(12)" to -- (11) --.

Signed and Sealed this

Twenty-first Day of May, 2002

*Attest:*

*Attesting Officer*

JAMES E. ROGAN
*Director of the United States Patent and Trademark Office*